US006951670B2

(12) United States Patent
Stroppiana

(10) Patent No.: US 6,951,670 B2
(45) Date of Patent: Oct. 4, 2005

(54) SYNTHETIC GRASS STRUCTURE

(75) Inventor: Fernando Stroppiana, Cuneo (IT)

(73) Assignee: Mondo S.p.A., Italian Nationality, Cuneo (IT)

( * ) Notice: Subject to any disclaimer, the term of this patent is extended or adjusted under 35 U.S.C. 154(b) by 0 days.

(21) Appl. No.: 10/367,072

(22) Filed: Feb. 14, 2003

(65) Prior Publication Data

US 2004/0033322 A1 Feb. 19, 2004

(30) Foreign Application Priority Data

Aug. 14, 2002 (IT) ..... TO2002A0723

(51) Int. Cl.[7] ..... B32B 5/16
(52) U.S. Cl. ..... 428/17; 428/87; 273/DIG. 13
(58) Field of Search ..... 428/17, 87; 273/DIG. 13

(56) References Cited

U.S. PATENT DOCUMENTS 5,958,527 A 9/1999 Prévost ..... 428/17

FOREIGN PATENT DOCUMENTS

DE 3721812 2/1989
EP 1158099 * 11/2001

OTHER PUBLICATIONS translation of German Patent No. 3721812 A1.*

* cited by examiner

*Primary Examiner*—Alexander S. Thomas
(74) *Attorney, Agent, or Firm*—Dorsey & Whitney LLP

(57) ABSTRACT

A synthetic grass structure comprises a sheet substrate with a plurality of filiform formations extending from the substrate so as to simulate natural grass cover and a particulate filling material or infill consisting of a substantially homogeneous mass of a granular plastic material dispersed between the filiform formations so as to keep them in a substantially upright condition. The infill forms a layer of thickness not greater than 40 millimeters, has a grain size smaller than 5 millimeters, and consists of plastic material with a value of elastic return such that the structure has a KA value of 35–50, which enables its use for making athletics tracks.

15 Claims, 1 Drawing Sheet

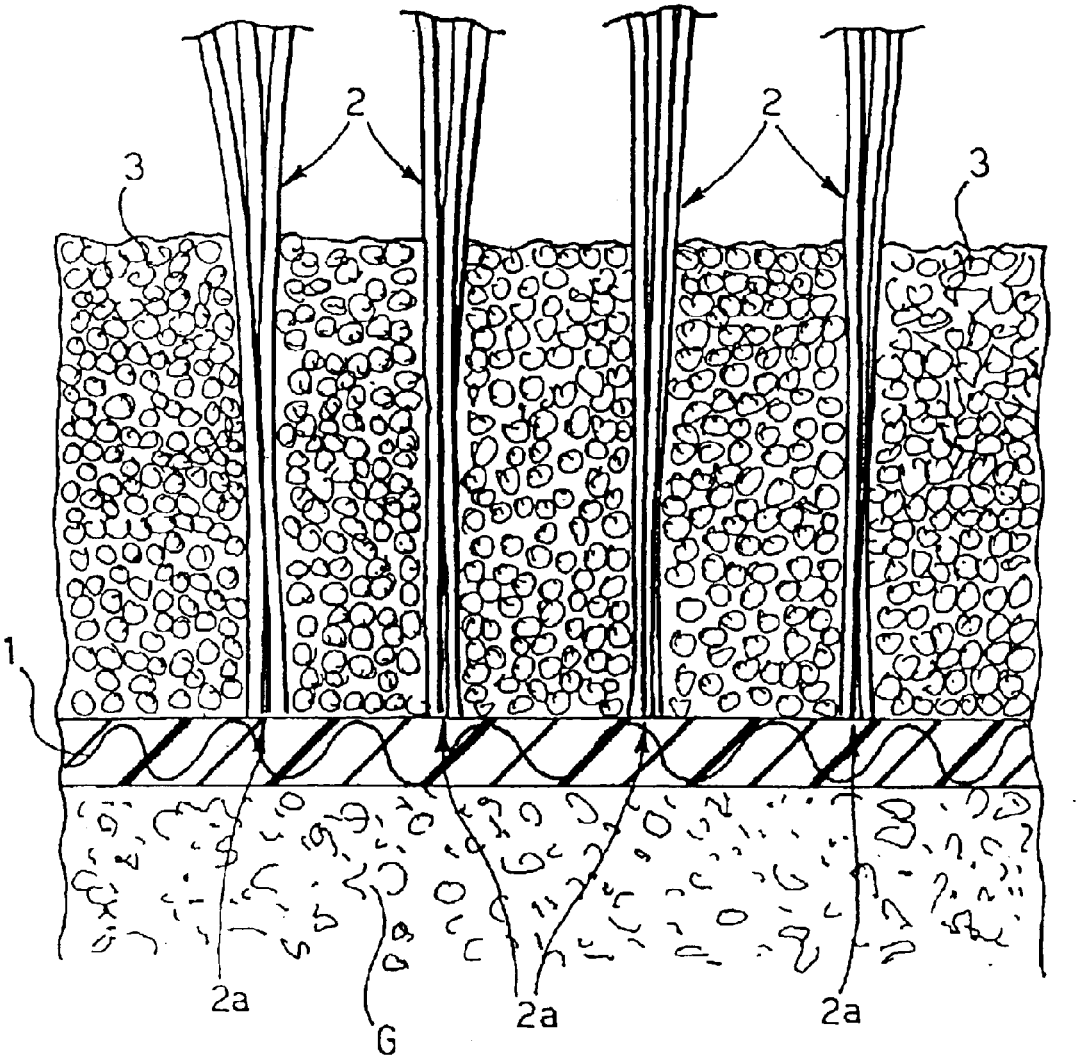
2
2
3
3
1
2a
G
2a
2a

SYNTHETIC GRASS STRUCTURE

CROSS REFERENCE TO RELATED APPLICATIONS

This application claims priority under 35 U.S.C. § 119 to Italian Application No. TO2002A000723, filed 14 Aug. 2002. This patent application is hereby incorporated by reference as if fully disclosed herein.

BACKGROUND

1. Technical Field

The present invention relates to a synthetic grass structure, and more particularly to a synthetic grass structure including a sheet substrate with a plurality of filiform formations extending from the substrate to simulate natural grass cover, and a particulate filling material, or infill, dispersed between said filiform formations so as to keep the filiform formations themselves in a substantially upright condition.

2. Related Art

A synthetic grass structure is known, for example, from U.S. Pat. No. 5,958,527. The solution described by the document cited above envisages that the aforesaid infill will comprise: a bottom layer, consisting practically exclusively of hard granular material, such as, typically, sand, a top layer, consisting practically exclusively of granules of complaint material, made up, for instance, of fragmented rubber, obtained preferentially as recycled rubber material from used tires, and an intermediate layer comprising a mixture of the two particulate materials mentioned above in selectively predetermined weight ratios.

From EP-A-1 158 099, there is known a synthetic grass structure in which the particulate infill consists of a substantially homogeneous mass of granular plastic material. This is typically a polyolefin-based or vinyl-polymer-based material.

SUMMARY

Generally, the present invention relates to a synthetic grass structure of the type comprising a sheet substrate with a plurality of filiform formations extending from the substrate to simulate natural grass cove, and a particulate infill consisting of a substantially homogeneous mass of a granular plastic material dispersed between said filiform formations so as to keep the filiform formations themselves in a substantially upright condition, wherein the particulate filling material or infill: a) forms a layer of thickness not greater than 40 millimeters; b) has a grain size smaller than 5 millimeters; and c) consists of material with a value of elastic return such that said structure has a value of KA in the 35–50 range.

BRIEF DESCRIPTION OF THE FIGURES

FIG. 1 displays an embodiment of the present invention.

DETAILED DESCRIPTION

Synthetic grass structures are frequently considered as valid alternatives to natural turf, above all for applications in which, for different reasons (environmental conditions, intense use, etc.), the upkeep of natural grass cover proves critical, as regards the expenses involved in its maintenance.

In particular, a known technique is to use synthetic grass structures of the type described for making tennis courts or five-a-side soccer pitches. In this case, the filiform formations have a length (measured with respect to the plane on which the sheet substrate is laid) in the region of 25–35 millimeters, and the layer of infill has typically a thickness in the region of 20–25 millimeters. These are synthetic grass structures that can be defined as short-pile or short-sward structures: they are typically rather "hard" underfoot, also because they have to favor bouncing of the ball during the course of the game.

The characteristics of hardness/compliance of a flooring, and in particular of a flooring for sports use, can be identified in a quantitatively precise way by resorting to the elastic-impact test forming the subject of the DIN standard 18035/6. The said standard, together with the DIN standard 18032/2, enables definition of a parameter or coefficient, referred to as KA (abbreviation of the German work Kraftabbau).

The coefficient KA corresponds substantially to a characterization, in percentage terms, of the behavior of the flooring subjected to the fall of a heavy object of normalized dimensions as compared to the behavior manifested in regard to the same load by a plane rigid surface, typically one made of cement.

Even though so far there do not exist specific standards in this connection, experimental tests conducted on floorings in widespread use have proved that synthetic grass structures for tennis courts or five-a-side football pitches of the type referred to previously have a KA in the region of 15–20.

Likewise known and extensively used are synthetic grass structures of the type described above for making full-sized soccer pitches.

In this case, the corresponding international organizations (in particular, FIFA and UEFA) have issued specific standards that impose, for said synthetic grass cover, KA values of between 55 and 70, designed to ensure that the synthetic grass structure reproduces as faithfully as possible the characteristics of a natural-turf football pitch.

To obtain KA values in the region of 55–70, it is necessary for the synthetic grass structure to be of a certain thickness. In this case, the filiform formations can have a length in the region of 60 millimeters, whilst the layer of particulate infill reaches thicknesses in the region of 50 millimeters.

The fact of having to resort to said thicknesses is evidently linked to the need to render the synthetic grass structure sufficiently compliant or "soft" to the tread: the "softer" the structure, the higher the KA; instead, the "harder" the flooring, the lower the KA.

Also for reasons of evident compatibility and uniformity of presence within the sports installation itself, it would certainly be advantageous to be able to extend the use of synthetic grass structures of the type described also to athletics tracks.

Athletics tracks usually have a coefficient KA of between approximately 35 and 50. The said range of values is expressly indicated in the document "Track and Field Facilities Manual," edited by the International Amateur Athletics Federation (1995 edition).

KA values in the range described, and in particular close to the highest value of 50 (corresponding to a flooring that proves rather "soft" in regard to the load applied by treading or running), can be obtained with synthetic grass structures of the type described previously. However, above all in the case of solutions involving the use of sand as partial or exclusive component of the particulate infill, the said result may be achieved only provided that rather thick structures are made, in which the distance between the plane in which the sheet substrate extends and the "surface of attack" of the structure by the athlete, namely the top surface of the layer of particulate infill, is not smaller than approximately 45 millimeters.

Synthetic grass structures having the above-mentioned characteristics of thickness do not, however, meet with the approval of athletes engaged in athletics events held thereon. This has emerged, above all, in relation to sports such as short-distance running, as well as sports such as long jumping, hop-step-and-jump, and pole vaulting, where the interaction between the foot (and the footwear) of the athlete and the structure on which the athlete has to run has a major horizontal component, i.e., a component tangential to the plane of the running surface.

In the types of sports referred to, in order to reach the maximum running speed, the athlete aims at exerting as strong a thrust as possible in the horizontal direction, and more often than not uses footwear provided with spike-like formations designed for penetrating the running surface in an attempt, precisely, to optimize the corresponding interactions.

Without wishing to be tied down to any specific theory in this connection, there is good reason to believe that the unfavorable impression of various athletes engaged in short-distance running events on synthetic grass structures derives from what has been mentioned above, namely that if the structure is too "thick", the major component of thrust in the horizontal direction exerted by the athlete results inevitably in a shear stress exerted through the layer of infill starting from the surface of engagement in the direction of the bottom surface. The result is that the surface of contact of the athlete's foot shifts backwards, and even though this movement backwards may be extremely contained, the athlete has the feeling of running on a "miry" surface.

The object of the present invention is to provide a synthetic grass structure that can be used in an altogether satisfactory way for making athletics tracks, overcoming the drawbacks outlined above.

According to the present invention, the said object is achieved thanks to a synthetic grass structure having the characteristics referred to specifically in the claims that follow.

The invention will now be described, purely by way of non-limiting example, with reference to the annexed drawings, consisting of a single figure, which reproduces in a schematic way an ideal vertical section of a synthetic grass structure according to the invention.

According to a solution that is by and large known, the aforesaid synthetic turf structure comprises a sheet substrate 1 designed to be laid on a subfloor G consisting, in the most typical conditions of use, of a subfloor of tamped soil or of a bituminous mat, on which the synthetic turf is laid, usually in free-laying conditions.

The sheet substrate 1 may consist of a sheet of plastic material such as, for example, a non-woven fabric, which is rubberized with the application, for instance, of latexes, such as for example SBR latex.

Starting from the substrate 1 there extends upwards a plurality of filiform formations 2 usually arranged in tufts so as to provide a better simulation of the blades of grass of natural grass cover.

The filiform formations 2 are anchored to the substrate 1 at their proximal ends, designated by 2*a*, and extend upwards with their distal ends for a total length, measured starting from the general plane of extension of the substrate 1, that is typically in the region of 30–35 millimeters.

The general criteria of construction of the substrate 1 and of the filiform formations 2 (including the modalities for obtaining firm anchorage of the proximal ends 2*a* of the filiform formations 2 on the substrate 1) are known to the art and hence do not call for a detailed description herein, also because they are in themselves not important for an understanding of the invention.

Of course, in view of the particular application for an athletics track, the solution may be preferred of making the filiform formations 2 with a red material, or black material, or a material having the color of soil, according to the choices most frequently adopted for making athletics tracks.

Dispersed on top of the substrate 1, and hence between the filiform formations 2, is a particulate, or granular, dispersed material (the terms "particulate" and "granular" here being used as synonyms), which functions as infill 3. The function of the material 3 is substantially that of keeping the filiform formations 2 in the upright condition, i.e., preventing them from lying down flat in an undesirable way on the substrate 1.

The particulate material 3 is dispersed between the filiform formations 2 in a sufficient amount to cause the filiform formations 2 themselves to be supported by the infill 3 for a length which, given the length of the formations 2 indicated previously (30–35 millimeters), is typically in the region of 20–25 millimeters. This means that the distal ends of the filiform formations 2 project from the top surface of the layer of infill 2 (which defines the so-called "surface of attack" by the athlete), a length that is typically in the region of 10 millimeters.

The synthetic grass structure according to the invention thus presents—at least in the currently preferred embodiment of the invention—as an intrinsically short-pile or short-sward structure.

For reasons of clarity, it should, however, be pointed out that the tests conducted by the present applicant demonstrate the possibility of achieving the results of the invention with values of thickness of the layer of infill 3 that reach approximately 40 millimeters, with consequent adaptation of the length of the filiform formations.

In any case, it appears preferable to resort to thicknesses of the layer of infill 3 of less than 30 millimeters, the choice in the 20 mm to 25 mm range currently being considered particularly preferred.

It is moreover evident that, in the determination and verification of the values referred to above, it is necessary to take into account the imprecisions/tolerances in any case involved in the methods for making and measuring the said structures, it also being necessary to take into account the fact that the material of the layer of infill 3 referred to is a particulate material for which the top surface of the layer (defined previously as "surface of attack") presents in any case a certain granularity.

The values mentioned previously and appearing in the ensuing claims must therefore be interpreted as being affected by tolerance margins, substantially similar considerations being applicable also to the other quantitative values that will be introduced hereinafter.

The particulate infill 3 is a substantially homogeneous material, dispersed on top of the substrate 1 and between the filiform formations 2 in a basically uniform way, without giving rise to superimposed layers with markedly different characteristics.

In the currently preferred embodiment of the invention, the aforesaid particulate material is a granular material with a grain size smaller than 5 millimeters, typically of between 0.5 and 4.5 millimeters and even more preferably between 0.5 and 1.5 millimeters, with a density of typically between 1.5 and 1.6 g/cm$^3$.

According to criteria that are, on the other hand, already known from EP-A-1 158 099, the material of the layer of infill 3 is a polyolefin material, such as for instance polyethylene, and even more preferably recycled polyolefin material, such as for example recycled polyethylene.

According to a further embodiment of the invention, the foresaid material consists of a vinyl polymer, for example PVC, and even more preferably a recycled vinyl polymer, for example recycled PVC.

As regards the modalities for obtaining the granular material and distribution of the granular material at the moment of laying useful reference may be made to the criteria already described in EP-A-1 158 099.

In the case of the present invention, it is important that the material that is to form the layer of particulate infill should present specific characteristics of elastic return.

The above characteristics can be achieved both at the level of selection of the starting material, and by adding to the material itself—above all when it is recycled material—plasticizing additives of a known type designed to a bestow on the material itself the desired characteristics of elastic return.

In particular, for the purposes of proper implementation of the invention, it is possible to make the particulate material 3 using a plastic material such as to present—as a compact body, and hence not in a particulate form—values of elastic return (defined on the basis of the DIN standard 53512) typically between 5% and 10%, preferably between 3% and 8%, and even more preferably 5%.

The above values, which appear also in the ensuing claims (and which should be interpreted with the margin of tolerance to which reference has already been made previously) refer to the plastic material designed to form the particulate infill 3 considered as compact body, and not in particulate form. In the case of the test referred to previously, the body consists of a plate having a thickness of approximately 5 millimeters.

The above choice aims at providing a reliable and repeatable reference so as to prevent the margins of uncertainty potentially linked to the fact referred to previously of determining characteristics of elastic return of a mass of particulate material.

The characteristics of the material defined previously enable KA values in the desired range of between 35 and 50 to be obtained, it being possible at the same time to make sufficiently thin synthetic grass structures (the distance between the plane of the subfloor and the surface of attack being typically in the region of 20–25 millimeters) and prevent altogether the "miry" phenomenon that athletes engaged in short-distance races on synthetic grass structures of greater thickness (for example of the type widely used for making football pitches) complain of.

Also in this case, albeit not wishing to be tied down to any specific theory in this connection, the present applicant has reason to believe that the combined choice of the values of grain size of the layer of particulate material 3 and the characteristics of compliance (elastic return) of the constituent material will give rise to a synergetic phenomenon such as to eliminate to a substantial extent, if not completely, the negative effects of the shear stress to which the layer of infill 3 is subject when an athlete exerts thereon a strong tangential stress in order to build up speed.

Also as regards the coloring of the layer of infill 3 there apply the same considerations already made with regard to the filiform formations 2, in particular as regards the possibility of adopting a particulate material having a red coloring, the color of soil or else black, with the choices most widely adopted as regards athletics tracks.

Of course, without prejudice to the principle of the invention, the details of implementation and the embodiments may be amply varied with respect to what has been described and illustrated herein, without thereby departing from the scope of the present invention.

What is claimed is:

1. A synthetic grass structure comprising:

a sheet substrate with a plurality of filiform formations extending from the substrate to simulate natural grass cover; and a particulate infill consisting of a substantially homogeneous mass of granular plastic material dispersed between said filiform formations so as to keep the filiform formations themselves in a substantially upright condition, wherein said particular filling material or infill:

forms a layer of thickness not greater than 40 millimeters;

has a grain size smaller than 5 millimeters; and consists of material with a value of elastic return such that said structure has a kraftabbau value in the range of 35–50.

2. The structure according to claim 1, wherein said particulate infill has a grain size of between 0.5 and 4.5 millimeters.

3. The structure according to claim 1, wherein said particulate material has a grain size of between 0.5 and 1.5 millimeters.

4. The structure according to claim 1, wherein said infill forms a layer of thickness not greater than 30 millimeters.

5. The structure according to claim 4, wherein said infill forms a layer of thickness of between 20 and 25 millimeters.

6. The structure according to claim 1, wherein said particulate material consists of material which, as compact body, has an elastic return of between 5% and 10%.

7. The structure according to claim 1, wherein said particulate material consists of material which, as compact body, has an elastic return of between 3% and 8%.

8. The structure according to claim 1, wherein said particulate material consists of material which, as compact body, has an elastic return substantially of 5%.

9. The structure according to claim 1, wherein said particulate material consists of a substantially homogeneous mass of a granular material chosen in the group consisting of polyolefin-based materials and vinyl-polymer-based materials.

10. The structure according to claim 9, wherein said particulate infill is polyethylene-based.

11. The structure according to claim 9, wherein said particulate infill is PVC-based.

12. The structure according to claim 1, wherein said particulate infill has a base of recycled polyolefin material.

13. The structure according to claim 1, wherein said particulate infill has a base of recycled vinyl polymer.

14. The structure according to claim 1, wherein said filiform formations have a color chosen between red, the color of soil, and black.

15. The structure according to claim 1, wherein said particulate material has a color chosen between red, the color of soil and black.

* * * * *